US007018325B2

(12) United States Patent
Shifferaw

(10) Patent No.: US 7,018,325 B2
(45) Date of Patent: Mar. 28, 2006

(54) WEIGHTLIFTING SYSTEM

(76) Inventor: Tessema Dosho Shifferaw, 1019 Solano Ave., Albany, CA (US) 94706

( * ) Notice: Subject to any disclaimer, the term of this patent is extended or adjusted under 35 U.S.C. 154(b) by 115 days.

(21) Appl. No.: 10/600,216

(22) Filed: Jun. 19, 2003

(65) Prior Publication Data

US 2004/0259696 A1 Dec. 23, 2004

(51) Int. Cl.
*A63B 21/072* (2006.01)
*A63B 21/078* (2006.01)

(52) U.S. Cl. ..... 482/104; 482/106; 482/135; 482/137; 482/142; 482/908

(58) Field of Classification Search ..... 482/92–94, 482/97, 104, 106–108, 135–138, 142, 908; 297/354.13, 361.1, 377
See application file for complete search history.

(56) References Cited

U.S. PATENT DOCUMENTS

| | | | | | |
|---|---|---|---|---|---|
| 560,517 | A | * | 5/1896 | Metzger | 482/108 |
| 4,205,838 | A | * | 6/1980 | McIntosh | 482/106 |
| 4,502,681 | A | * | 3/1985 | Blomqvist | 482/130 |
| 4,529,198 | A | * | 7/1985 | Hettick, Jr. | 482/104 |
| 4,566,691 | A | * | 1/1986 | Mahnke | 482/104 |
| 4,575,077 | A | * | 3/1986 | Osborne et al. | 482/137 |
| 4,799,673 | A | * | 1/1989 | Selle | 482/104 |
| 4,822,034 | A | * | 4/1989 | Shields | 482/106 |
| 4,971,318 | A | | 11/1990 | Tracy | |
| 4,982,957 | A | * | 1/1991 | Shields | 482/104 |
| 5,060,939 | A | * | 10/1991 | Oswald et al. | 482/142 |
| 5,066,004 | A | * | 11/1991 | Jones | 482/137 |
| 5,116,297 | A | * | 5/1992 | Stonecipher | 482/97 |
| 5,123,885 | A | | 6/1992 | Shields | |
| 5,141,480 | A | * | 8/1992 | Lennox et al. | 482/104 |
| 5,415,607 | A | | 5/1995 | Carpenter | |
| 5,429,570 | A | * | 7/1995 | Beyer | 482/104 |
| 5,462,510 | A | * | 10/1995 | Ish, III | 482/142 |
| 5,630,776 | A | | 5/1997 | Yang | |
| 5,839,997 | A | | 11/1998 | Roth et al. | |
| 6,033,350 | A | | 3/2000 | Krull | |
| 6,039,678 | A | | 3/2000 | Dawson | |

(Continued)

FOREIGN PATENT DOCUMENTS

EP 1498158 A1 * 1/2005

(Continued)

OTHER PUBLICATIONS

Yukon Fitness Equipment, TK-400 Caribou II Gym, 1994-95 Catalog.*

*Primary Examiner*—Stephen R. Crow
*Assistant Examiner*—Victor K. Hwang
(74) *Attorney, Agent, or Firm*—Edward S. Wright

(57) ABSTRACT

Weightlifting system having a bench, a pair of weight stands on opposite sides of the bench, an elongated bar extending over the bench between the weight stands, and weight plates on the weight stands for selective attachment to the bar without being removed from the weight stands. The bench can be moved between raised and lowered positions relative to the bar, and individually operable leg extension bars are positioned at one end of the bench, with weight plates resting on supports near the leg extension bars adapted to be selectively attached to the leg extension bars without being removed from the supports. In one disclosed embodiment, a frame having a pair of upright posts is positioned between the weight stands, and a pair of guides are connected to the bar and mounted on the posts for movement along the posts.

20 Claims, 4 Drawing Sheets

U.S. PATENT DOCUMENTS

| | | | | |
|---|---|---|---|---|
| 6,149,558 | A | 11/2000 | Chen | |
| 6,186,928 | B1 | 2/2001 | Chen | |
| D464,094 | S * | 10/2002 | Fond | D21/681 |
| 6,565,495 | B1 * | 5/2003 | Slattery | 482/142 |
| 6,682,464 | B1 * | 1/2004 | Shifferaw | 482/106 |
| 6,685,601 | B1 * | 2/2004 | Knapp | 482/104 |
| 2004/0138031 | A1 * | 7/2004 | Krull | 482/104 |
| 2005/0003937 | A1 * | 1/2005 | Chen | 482/94 |
| 2005/0192166 | A1 * | 9/2005 | Shifferaw | 482/94 |
| 2005/0192167 | A1 * | 9/2005 | Shifferaw | 482/94 |

FOREIGN PATENT DOCUMENTS

| | | |
|---|---|---|
| JP | 08277983 | 10/1996 |

* cited by examiner

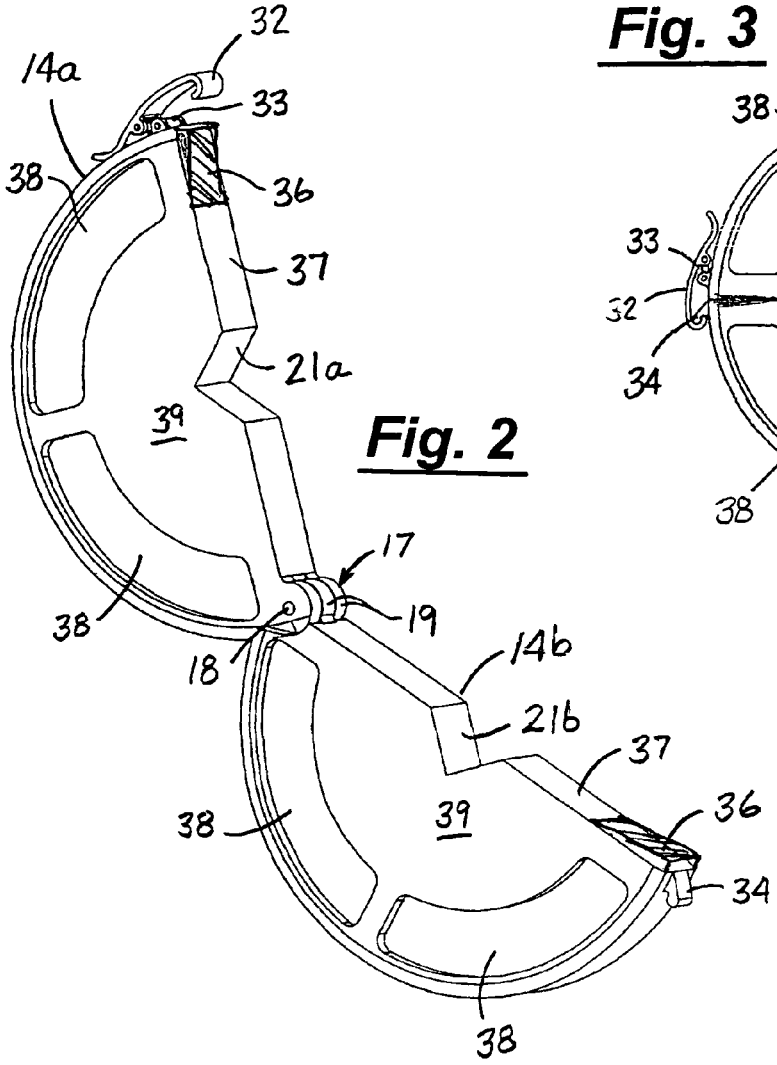
Fig. 2
Fig. 3
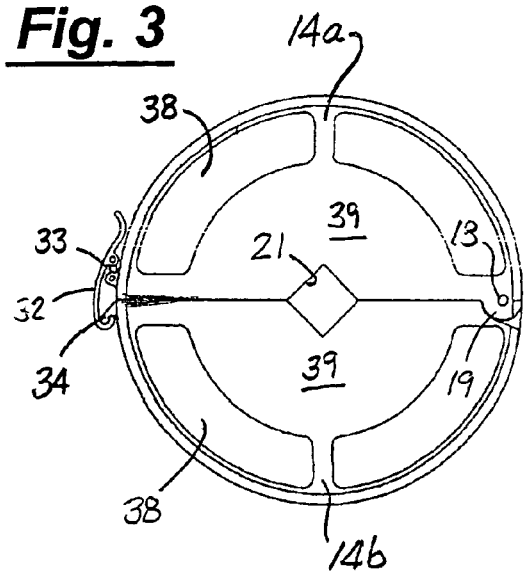
Fig. 4
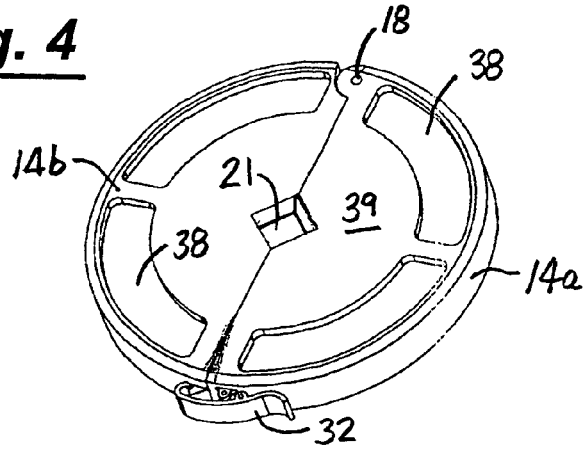

Fig. 5
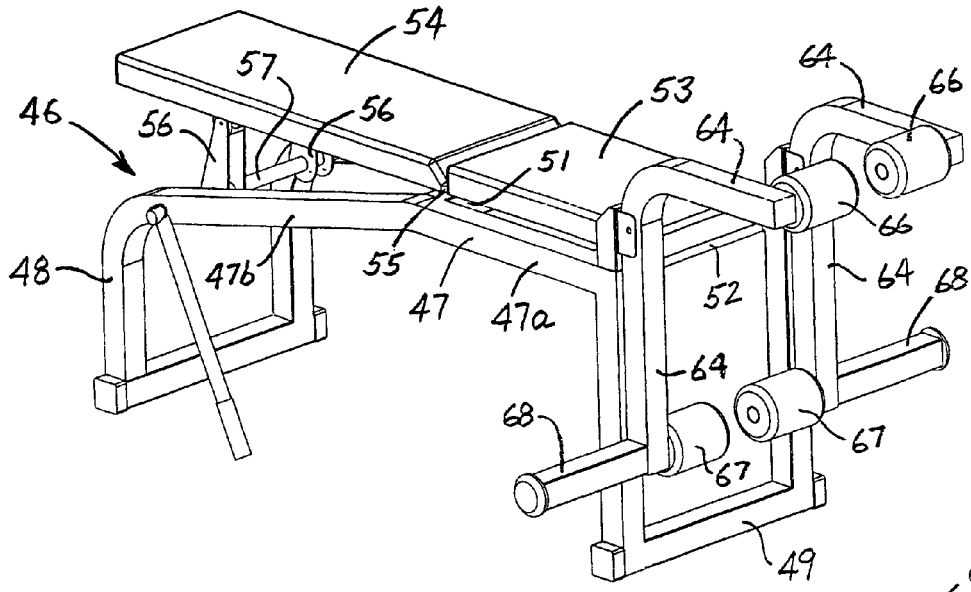
Fig. 6
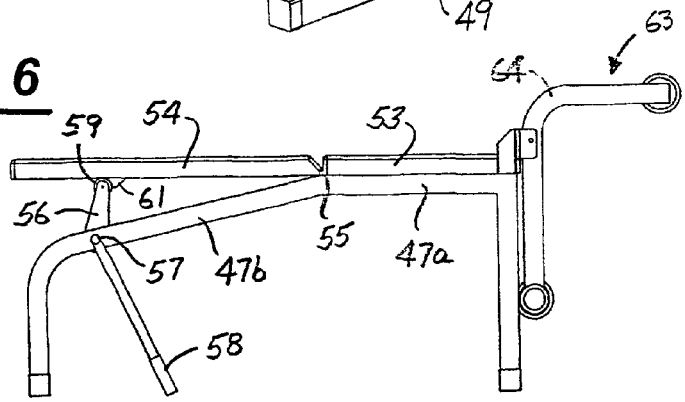
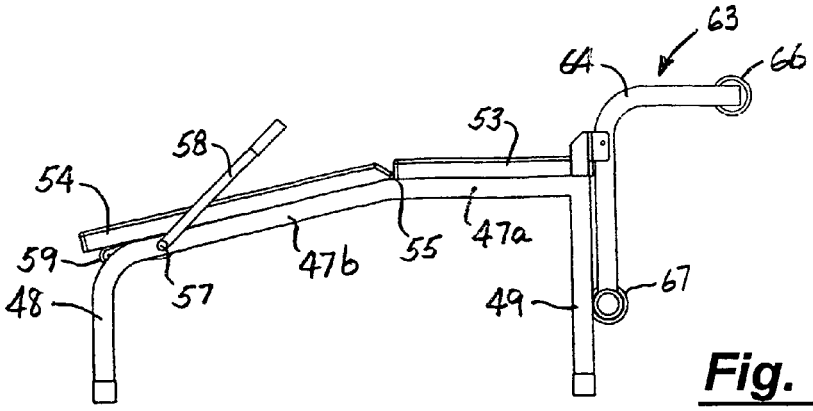
Fig. 7

WEIGHTLIFTING SYSTEM

BACKGROUND OF THE INVENTION

1. Field of Invention

This invention pertains generally to exercise and fitness equipment and, more particularly, to an improved weightlifting system.

2. Related Art

Notwithstanding the numerous types of exercise and fitness equipment which have been developed in recent years, free weights or barbells still remain one of the most popular. Such devices typically consist of an elongated bar, a plurality of interchangeable weight plates which are mounted on the end portions of the bar, and collars which retain the weight plates in place.

Changing the weight on the bar requires removal of the outer collars, the lifting of weight plates onto and/or off of the bar, and replacement of the collars. This takes time and, in addition to being inconvenient, can be difficult for a smaller person who must remove the heavier plates left on the bar by a stronger prior user. Also, in handling weight plates, there is always a danger of personal injury or property damage if the plates are dropped or inadvertently banged together.

Another problem in the use of free weights arises when the lifter is doing exercises on a bench, with the bar above him. As the lifter does his exercise, he tends to tire, and a spotter is often required to help him lift the bar away from his body at the end of the exercise so he can get out from under it.

OBJECTS AND SUMMARY OF THE INVENTION

It is, in general, an object of the invention to provide a new and improved weightlifting system.

Another object of the invention is to provide a weightlifting system of the above character in which the weight plates on a bar can be changed without lifting them or carrying them around.

Another object of the invention is to provide a weightlifting system of the above character which a person can use by himself without help from others.

These and other objects are achieved in accordance with the invention by providing a weightlifting system having a bench, a pair of weight stands on opposite sides of the bench, an elongated bar extending over the bench between the weight stands, and weight plates on the weight stands for selective attachment to the bar without being removed from the weight stands. The bench can be moved between raised and lowered positions relative to the bar, and individually operable leg extension bars are positioned at one end of the bench, with weight plates resting on supports near the leg extension bars adapted to be selectively attached to the leg extension bars without being removed from the supports. In one disclosed embodiment, a frame having a pair of upright posts is positioned between the weight stands, and a pair of guides are connected to the bar and mounted on the posts for movement along the posts.

BRIEF DESCRIPTION OF THE DRAWINGS

FIG. 2 is a front isometric view of one of the weight plates in the embodiment of FIG. 1 in an open position.

FIG. 3 is a rear elevational view of the weight plate of FIG. 2 in a closed position.

FIG. 4 is a front isometric view of the weight plate of FIG. 2 in a closed position.

FIG. 5 is an enlarged isometric view of the adjustable bench in the embodiment of FIG. 1.

FIGS. 6 and 7 are side elevational views of the bench of FIG. 5 in raised and retracted positions.

DETAILED DESCRIPTION

Figure 1:
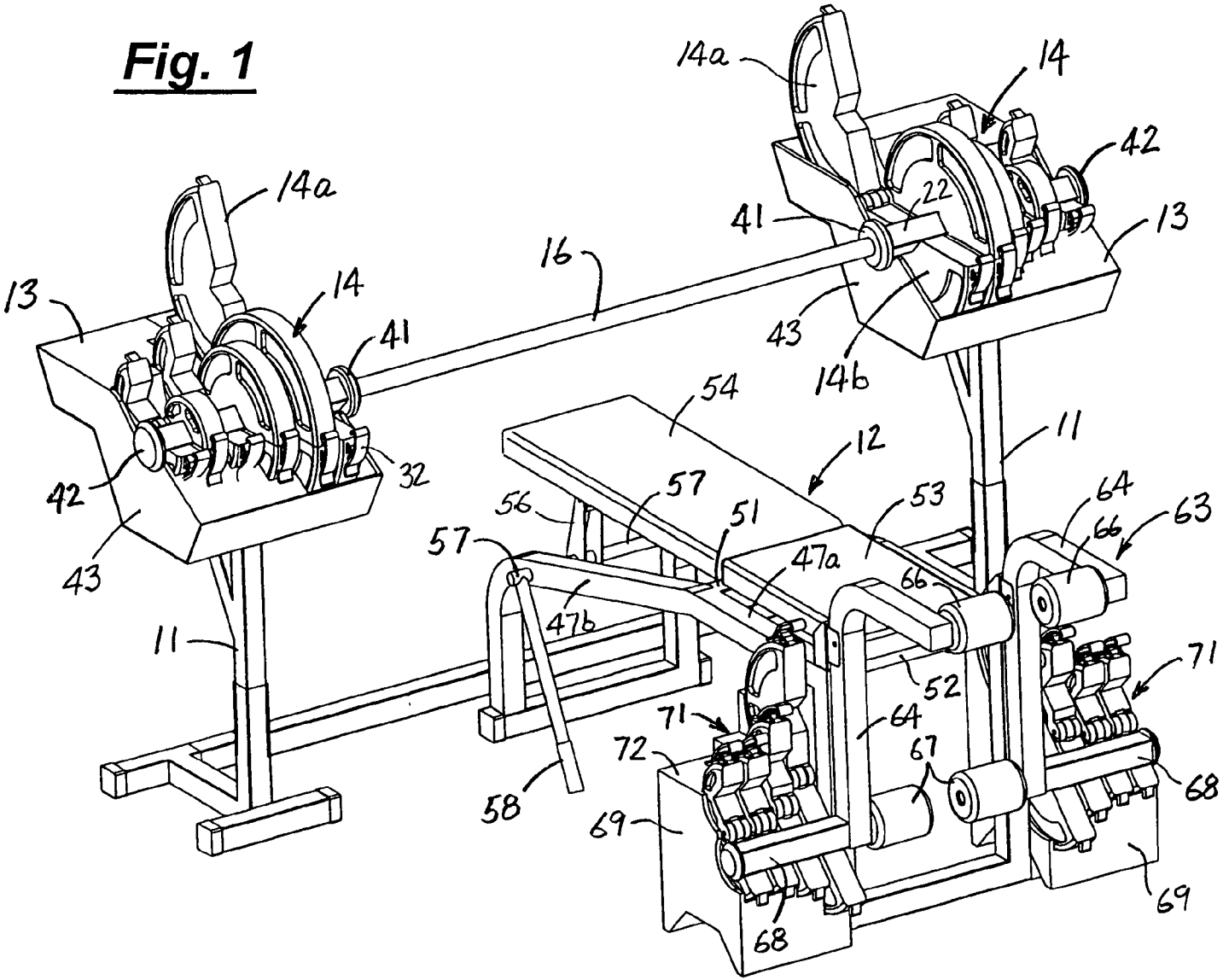
FIG. 1 is an isometric view of one embodiment of a weightlifting system incorporating the invention.

As illustrated in FIG. 1, the weightlifting system includes a pair of weight stands 11 which are positioned on opposite sides of a bench 12. A tray 13 at the top of each stand holds a plurality of weight plates 14 in an upright, side-by-side position for selective attachment to an elongated bar 16 which extends over the bench and between the stands. If desired, the weight stands can be made adjustable in height in order to adjust the rest position of the bar.

As best seen in FIGS. 2–4, each of the weight plates has two semicircular sections 14*a*, 14*b* which are hinged together at 17 for movement between open and closed positions. In the embodiment illustrated, the hinge consists of a pin 18 which passes through interleaved flanges 19 that are formed as integral parts of the plates.

Each plate has a central opening 21 through which the bar extends. The opening is formed partly in each of the two sections 14*a*, 14*b*, and when the plate is in its closed position, the walls of the opening encircle the bar. In the open position, the bar rests only in the portion 21*b* of the opening in the lower section of the plate and is free to be lifted into and out of it.

In the embodiment illustrated, both the openings 21 in the plates and the end portions 22 of the bar have a square shape, which prevents the weights from rotating on the bar and ensures that they will be oriented correctly upon return to the weight trays.

The two sections of the weight plates are held in the closed position by a clasp 32 which is mounted on one of the sections by an over-center linkage 33 and a lug 34 on the other. Resilient rubber pads 36 are mounted on the confronting edges 37 of the two sections, and arcuately extending recesses 38 are formed in the side faces 39 of the plates to facilitate handling of the plates.

Collars or flanges 41, 42 are affixed to the bar at the inner and outer ends of areas in which the weight plates are attached. In addition to preventing the plates from sliding along or falling off the bar, these flanges also serve as guides for returning the bar to the proper axial position in weight trays 13. In this regard, it will be noted that the spacing between the flanges is slightly greater than the distance between the outer surfaces 43 of the side walls of the weight trays and that the flanges are on opposite sides of the trays when the bar is in the correct axial position.

If desired, each of the weight plates can be individually retained in an axial position on the bar by a locating pin (not shown) which extends from either the weight plate or the bar and is received in the other.

Bench 12 has a supporting frame 46 with side rails 47 and legs 48, 49 at the head and foot ends of the rails. Each of the rails has a horizontal section 47*a* toward the foot of the bench and a downwardly inclined section 47*b* toward the head. Cross members 51, 52 extend between the rails at the ends of the horizontal sections.

A seat 53 is mounted in a stationary position on the horizontal section of the frame, and a backrest 54 is mounted on the inclined section for movement between raised and lowered positions. The inner end of the backrest is pivotally mounted to cross member 51 by a hinge 55, and the outer end is supported by a pair of lift arms 56. The lift arms are affixed to a shaft 57 which is rotatively mounted between the side rails of the frame. An operating handle or lever 58 is affixed to the shaft on one side of the bench and provides means for a person on the bench to raise and lower the backrest.

The lift arms include rollers 59 which engage the under side of the backrest in cam-like fashion, and stops 61 on the backrest limit rotation of the arms in one direction. The backrest is brought a horizontal position by rotation of the handle in a downward direction until the rollers abut against the stops. As best seen in FIG. 6, the stops are positioned somewhat closer horizontally to the hinge than the shaft, and the arms lean back toward the stops when the backrest is in the horizontal or raised position. Consequently, the weight of the person on the bench urges the rollers against the stops and locks the backrest in the horizontal position.

The backrest is lowered to an inclined position by rotating the handle in an upward direction as illustrated in FIG. 7. By lowering the backrest in this manner, a person can get onto and off of the bench with the bar in a relatively low position, e.g. resting on the weight stands. This makes it possible for him to do exercises such as bench presses without the help of a spotter.

A pair of individually operable leg extension bars 63 are provided at the foot of the bench. Each of these bars includes an L-shaped arm 64 which is pivotally mounted to the frame, with rollers 66, 67 extending in an inward direction at the upper and lower ends of the arms. Weight bars 68 extend in an outward direction at the lower ends of the arms in axial alignment with rollers 67.

Weight trays 69 are positioned on opposite sides of the bench near weight bars 68. Each of these trays holds a plurality of weight plates 71 in a side-by-side position for selective attachment to weight bars 68. These plates are similar to weight plates 14 and are attached to the weight bars in the same manner those plates are attached to barbell bar 16. Weight trays 69 have generally rectangular housings 72 which can also serve as footrests for a person on the bench.

Operation and use of the weightlifting system is as follows. With bar 16 resting in weight trays 13, a person wishing to do an exercise with the barbell selects the amount of weight he wants to lift by simply swinging the upper sections of the desired plates down onto the lower sections and locking them in place with clasps 32.

He can then get onto the bench, with backrest 54 in its lowered position, and position himself beneath the bar. He raises the bench to its horizontal position by pushing down on handle 58 and does his exercise. When he is done with the exercise, he returns the bar to its rest position, with the weight plates resting in the weight trays, then lifts the handle to lower the backrest so he can get out from under the bar.

For leg exercises, he attaches the desired plates 71 to each of weight bars 68 by simply swinging the upper sections of the plates down onto the lower sections and locking them in place. As noted above, the leg bars are independent of each other, and different amounts of weight can be used on the two, if desired.

To do leg extensions, a person sits on seat 53, with his upper legs over rollers 66 and his lower legs behind rollers 67, then extends and bends his legs at the knee. When he is done with the exercise, the weights will return to the trays, and because of the manner in which the plates are attached to the bars, he can change them while seated on the bench.

Figure 8:
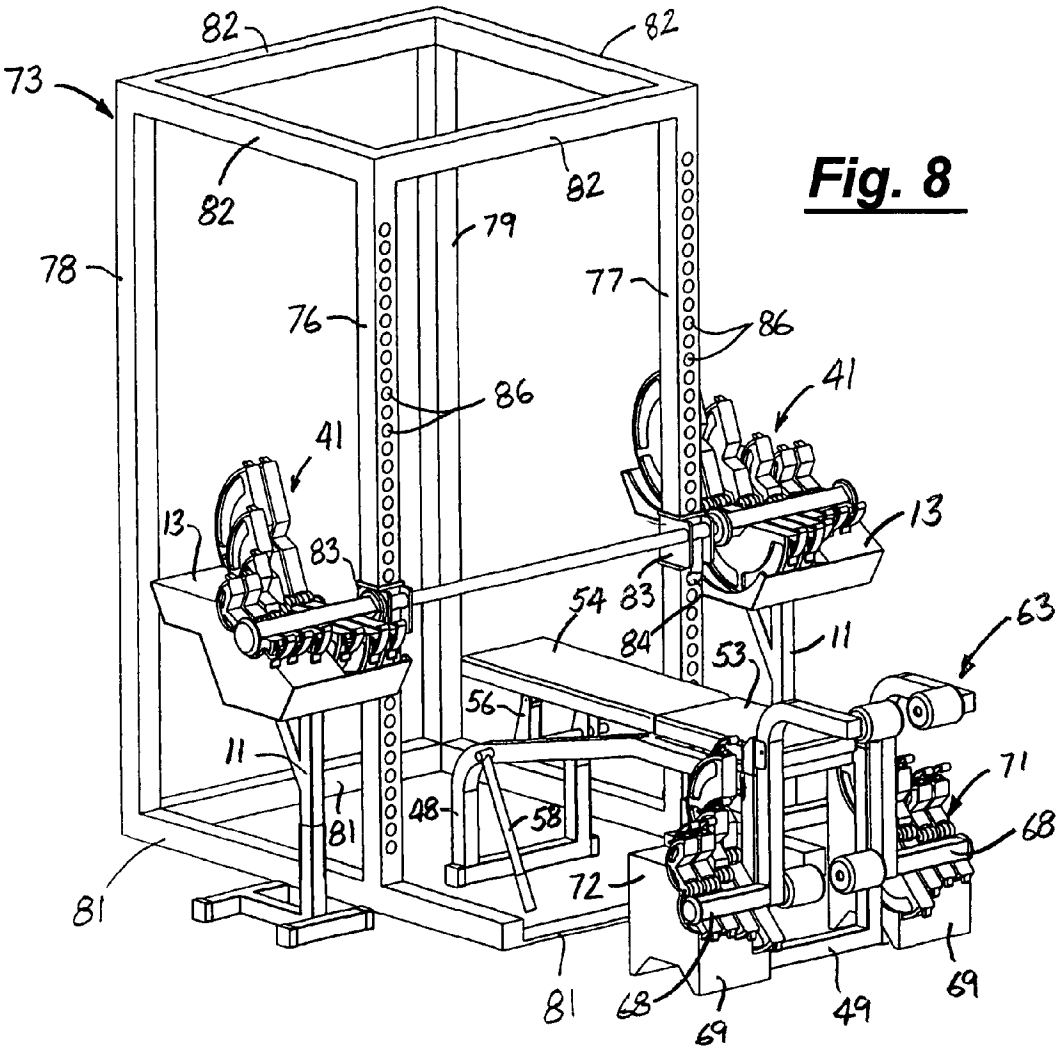
FIG. 8 is an isometric view of another embodiment of a weightlifting system incorporating the invention.

The embodiment shown in FIG. 8 is similar to the embodiment of FIG. 1, with the addition of a frame 73 which serves as a guide for the barbell. The frame has four upright members or posts 76–79 mounted on a rectangular base 81 and connected together at their upper ends by rails 82.

Guide sleeves 83 are slidably mounted on posts 76, 77 and connected to bar 16 to constrain the bar for vertical movement along the posts. In the embodiment illustrated, the bar is connected to the guides by passing the bar through aligned openings in flanges which extend rearwardly from the sleeves.

Means is provided for holding the bar in a rest position at a desired height. That means includes pins 84 which can be selectively engaged with holes 86 that spaced along the length of posts 76, 77. The pins extend from the holes, and the guide sleeves rest upon the exposed portions of the pins.

Operation and use of the embodiment of FIG. 8 is similar to that of the embodiment of FIG. 1, the only difference being the function of the guide posts and sleeves in constraining the barbell for movement in a vertical direction and in holding it at a desired rest height.

It is apparent from the foregoing that a new and improved weightlifting system has been provided. While only certain presently preferred embodiments have been described in detail, as will be apparent to those familiar with the art, certain changes and modifications can be made without departing from the scope of the invention as defined by the following claims.

The invention claimed is:

1. A weightlifting system, comprising a pair of laterally spaced weight stands, an elongated bar extending between the weight stands, a plurality of weight plates disposed side-by-side in upright positions on each of the stands, the plates being formed in sections of substantially equal size and weight which are hinged together and adapted to be selectively attached to the bar by movement between open and closed positions, and means for holding the plates in their upright positions on the stands when the plates are detached from the bar.

2. The weightlifting system of claim 1 including a bench positioned beneath the bar for receiving a person using the system.

3. The weightlifting system of claim 2 wherein the bench is movable between raised and lowered positions.

4. The weightlifting system of claim 2 wherein the bench is pivotally mounted for movement between a horizontal position and a downwardly inclined position.

5. A weightlifting system, comprising a pair of laterally spaced weight stands, an elongated bar extending between the weight stands, a plurality of weight plates disposed side-by-side in an upright position on each of the stands, the plates being formed in sections which are hinged together and adapted to be selectively attached to the bar by movement between open and closed positions, a bench positioned beneath the bar for receiving a person using the system, a pair of individually operable leg extension bars at one end of the bench, a weight tray beneath each of the leg extension bars, and a plurality of weight plates resting side-by-side in an upright position in each of the trays for attachment to the leg extension bars.

6. The weightlifting system of claim 5 wherein the plates in the trays are formed in sections which are hinged together for movement between open and closed positions and have openings through which the leg extension bars pass.

7. A weightlifting system, comprising a pair of laterally spaced weight stands, an elongated bar extending between the weight stands, a plurality of weight plates disposed side-by-side in an upright position on each of the stands, the plates being formed in sections which are hinged together and adapted to be selectively attached to the bar by movement between open and closed positions, a frame having a pair of upright posts positioned between the weight stands, and a pair of guides which are connected to the bar and mounted on the posts for movement along them.

8. The weightlifting system of claim 7 including means limiting downward movement of the guides along the posts to define a rest position for the bar.

9. A weightlifting system, comprising bench, a pair of weight stands on opposite sides of the bench, an elongated bar extending over the bench between the weight stands, a plurality of weight plates disposed side-by-side in upright positions on each of the weight stands for selective attachment to the bar, means for holding the plates in their upright positions on the stands when the plates are detached from the bar, a lifting arm which engages the under side of the bench in cam-like fashion and is affixed to a shaft for rotation between upright and retracted positions, and a handle operable by a person on the bench for turning the shaft to move the arm between the upright and retracted positions and thereby move the bench between raised and lowered positions relative to the bar.

10. A weightlifting system, comprising a bench, a pair of weight stands on opposite sides of the bench, an elongated bar extending over the bench between the weight stands, plurality of weight plates disposed side-by-side in upright positions on each of the weight stands for selective attachment to the bar, means for holding the plates in their upright positions on the stands when the plates are detached from the bar,a pair of individually operable leg extension bars at one end of the bench, and a plurality of weight plates formed in sections that are hinged together for selective attachment to the leg extension bars.

11. A weight lifting system, comprising a frame having a pair of upright posts, an elongated bar constrained for movement along the posts, a bench positioned between the posts and beneath the bar, a pair of weight stands on opposite sides of the frame near the posts, and a plurality of weight plates on each of the stands adapted to be selectively attached to the bar without being removed from the weight stands.

12. A weightlifting system, comprising a frame having a pair of upright posts, an elongated bar attached to sleeves which are slidably mounted on the posts for movement along the same, a bench positioned between the posts and beneath the bar, a pair of weight stands on opposite sides of the frame near the posts, ends plurality of weight plates on each of the stands adapted to be selectively attached to the bar without being removed from the weight stands.

13. The weightlifting system of claim 12 including stops on the posts for holding the bar in a predetermined rest position.

14. A weightlifting system, comprising a frame having a pair of upright posts, an elongated bar constrained for movement along the posts, a bench positioned between the posts and beneath the bar, a pair of weight stands on opposite sides of the frame near the posts, a plurality of weight plates on each of the stands adapted to be selectively attached to the bar without being removed from the weight stands, a pair of individually operable leg extension bars at one end of the bench, and a plurality of weight plates resting on supports near the leg extension bars and adapted to be selectively attached to the leg extension bars without being removed from the supports.

15. A weightlifting system, comprising a horizontally extending bar, a plurality of weight plates removably mounted on the bar, means supporting the bar at a predetermined rest height, a bench having a support pivotally mounted on a frame beneath the bar for movement between a horizontal position and a downwardly inclined position, a lifting arm which engages the under side of the support in cam-like fashion and is affixed to a shaft mounted on the frame for rotation between upright and retracted positions, and a handle operable by a person on the bench for turning the shaft to move the arm between the upright and retracted positions and thereby move the support between the horizontal and downwardly inclined positions.

16. A weightlifting system, comprising a horizontally extending bar, a plurality of weight plates removably mounted on the bar, means supporting the bar at a predetermined rest height, a bench having a section pivotally mounted on a frame beneath the bar for movement between a horizontal position and a downwardly inclined position, a pair of individually operable leg extension bars mounted on the frame at an end of the bench away from the bar, and a plurality of weight plates resting on supports for selective attachment to the leg extension bars without being removed from the supports.

17. A weightlifting system, comprising a bench, a pair of weight stands on opposite sides of the bench, an elongated bar extending over the bench between the weight stands, a plurality of weight plates disposed side-by-side in an upright position on each of the weight stands, the plates being formed in sections which are hinged together and adapted to be selectively attached to the bar by movement between open and closed positions, means for moving the bench between raised and lowered positions relative to the bar, a pair of individually operable leg extension bars at one end of the bench, a weight tray near each of the leg extension bars, and a plurality of weight plates resting in the weight trays for selective attachment to the leg extension bars.

18. The weightlifting system of claim 17 including a frame having a pair of upright posts positioned between the weight stands, and a pair of guides which are connected to the bar and mounted on the posts for movement along them.

19. A weightlifting system, comprising a pair of laterally spaced weight stands, an elongated bar extending between the weight stands, a plurality of weight plates which are disposed side-by-side in upright positions on each of the stands and formed in sections of substantially equal size and weight which are hinged together and adapted to be selectively attached to the bar by movement between open and closed positions without being removed from the weight stands, means for holding the plates in their upright and open positions on the stands when the plates are detached from the bar, and means for supporting a person in position for exercising with the bar and the weights attached thereto.

20. The weightlifting system of claim 19 wherein the means for supporting a person includes a bench positioned beneath the bar.

* * * * *